US007008489B2

(12) United States Patent
Bania

(10) Patent No.: US 7,008,489 B2
(45) Date of Patent: Mar. 7, 2006

(54) HIGH STRENGTH TITANIUM ALLOY

(75) Inventor: Paul J. Bania, Boulder City, NV (US)

(73) Assignee: Ti-Pro LLC, Boulder City, NV (US)

( * ) Notice: Subject to any disclaimer, the term of this patent is extended or adjusted under 35 U.S.C. 154(b) by 342 days.

(21) Appl. No.: 10/443,047

(22) Filed: May 22, 2003

(65) Prior Publication Data

US 2004/0231756 A1 Nov. 25, 2004

(51) Int. Cl.
*C22C 14/00* (2006.01)

(52) U.S. Cl. ..... 148/421; 420/418; 420/419; 420/420; 420/421

(58) Field of Classification Search ..... 148/421; 420/418, 419, 420, 421
See application file for complete search history.

(56) References Cited

U.S. PATENT DOCUMENTS 4,738,822 A * 4/1988 Bania ..... 420/419
4,878,966 A * 11/1989 Alheritiere et al. ..... 148/421
4,980,127 A * 12/1990 Parris et al. ..... 420/418
5,160,554 A * 11/1992 Bania et al. ..... 148/407
5,219,521 A * 6/1993 Adams et al. ..... 420/418
5,399,212 A * 3/1995 Chakrabarti et al. ..... 148/421
6,228,189 B1 * 5/2001 Oyama et al. ..... 148/669

OTHER PUBLICATIONS

M.J. Donachie Jr.: "Titanium A Technical Guide" 1988, ASM, Metal Park, Ohio, US, XP002299937, pp. 449-452.
Spiekermann P:,"Legierungen-ein Besonderes Patentrechtliches Problem?—Legierungspruefung im Europaeischen Patentamt-" Mitteilungen Der Deutschen Patentanwaelte, Heymann, Koln, DE, 1993, pp. 178-190, XP000961882, ISSN: 0026-6884.

* cited by examiner

*Primary Examiner*—John P. Sheehan
(74) *Attorney, Agent, or Firm*—Finnegan, Henderson, Farabow, Garrett & Dunner LLP

(57) ABSTRACT

An alpha-beta, titanium-base alloy with improved ductility at high strength levels compared to commercially available alloys, such as Ti-17. The alloy exhibits at least a 20% improvement in ductility at a given strength level compared to Ti-17. The alloy comprises, in weight %, 3.2 to 4.2 Al, 1.7 to 2.3 Sn, 2 to 2.6 Zr, 2.9 to 3.5 Cr, 2.3 to 2.9 Mo, 2 to 2.6 V, 0.25 to 0.75 Fe, 0.01 to 0.8 Si, 0.21 max. Oxygen and balance Ti and incidental impurities.

6 Claims, No Drawings

HIGH STRENGTH TITANIUM ALLOY

BACKGROUND OF THE INVENTION

1. Field of the Invention

The invention relates to an alpha-beta titanium-base alloy having an outstanding combination of tensile strength, including shear strength and ductility.

2. Description of the Prior Art

There have been numerous titanium alloys developed since the titanium industry started in earnest in the early 1950's. While these various alloy development efforts often had different goals for the end product alloy, some being developed with the intent of improving high temperature capability, some with improved corrosion resistance, and even some with improved forging/forming capabilities, perhaps the most common goal was simply tensile strength capability. In this case, tensile strength implies "useable" tensile strength, i.e., at an acceptable ductility level. Since strength and ductility vary inversely with each other, as is the case for virtually all hardenable metal systems, one usually has to make trade-offs between strength and ductility in order to obtain an alloy that is useful for engineering applications.

Standard (uniaxial) tensile properties are usually described by four properties determined in a routine tensile test: yield strength (YS), ultimate tensile strength (UTS, commonly referred to simply as "tensile strength"), % Elongation (% El) and % Reduction in Area (% RA). The first two values are usually reported in units such as 'ksi' (thousands of pounds per square inch) while the later two (both measures of ductility) are simply given in percentages.

Another tensile property often cited, particularly in reference to fastener applications, is "double shear" strength, also reported in ksi. For this property, ductility is not determined, nor is a yield strength. In general, double shear strength of titanium alloys are approximately 60% of the uniaxial tensile strengths, as long as uniaxial ductility is sufficient.

When attempting to make comparisons of tensile properties from different alloys heat treated to a range of tensile strength/ductility combinations, it is convenient to first analyze the data by regression analysis. The strength/ductility relationship can usually be described by a straight-line x-y plot wherein the ductility (expressed as either % El or % RA) is the dependent variable and the strength (usually UTS) is the independent variable. Such a line can be described the simple equation:

$$\% RA = b - m(UTS); \quad \text{Eqn 1}$$

where m=the slope of the straight line and b is the intercept at zero strength. [Note: When determining such an equation by regression analysis, a parameter referred to as "r-squared" is also calculated, it varies between zero and one—with a value of one indicating a perfect fit with the straight line equation and a value of zero indicating no fit].

Once such an equation is established, it can be used, for example, to compare 'calculated' ductilities at a constant strength level, even if there is no specific data at that strength level. This methodology has been used throughout this development effort in order to rank and compare alloys.

It should also be noted that when conducting an alloy development project, it is important to recognize that tensile strength/ductility relationships are significantly affected by the amount of hot-work that can be imparted to the metal during conversion from melted ingot to wrought mill product (such as bar). This is due to the fact that macrostructure refinement occurs during ingot conversion to mill product and the greater the macrostructure refinement the better the strength/ductility relationships. It is thus well understood by those skilled in the art that tensile strength/ductility relationships of small lab heats are significantly below those obtained from full sized production heats due to the rather limited amount of macrostructure refinement imparted to the small laboratory size heats compared to full-sized production heats. Since it is a practical impossibility to make full-size heats and convert them to mill product in order to obtain tensile property comparisons, the accepted practice is to produce smaller lab-sized heats of both the experimental alloy formulations and an existing commercial alloy formulation and compare results on a one-to-one basis. The key is to choose a commercial alloy with exceptional properties. In the development program resulting in this invention, the commercial alloy designated as "Ti-17" (Ti-5A1-2Sn-2Zr-4Cr-4Mo) was chosen as the baseline commercial alloy against which the experimental alloys would be compared. This alloy was chosen because of the exceptional strength/ductility properties demonstrated by this alloy in bar form.

TABLE 1

Tensile and Shear Strength Data from a commercial high strength titanium alloy (Ti-17) processed to bar*

| Alloy Chemistry (wt %) | Age (Deg F. / HRS) | YS (ksi | UTS (ksi) | % EI | % RA | Double Shear (ksi) | Double Shear as % of UTS | Avg Double Shear a % of UTS |
|---|---|---|---|---|---|---|---|---|
| Ti-17 (Ti-5Al-2Sn-2Zr-4Cr-4Mo) | 1100/8 | 182 | 183 | 12 | 44 | 114 | 62% | |
| Ti-17 (Ti-5Al-2Sn-2Zr-4Cr-4Mo) | " | 183 | 184 | 14 | 39 | 118 | 64% | |
| Ti-17 (Ti-5Al-2Sn-2Zr-4Cr-4Mo) | " | 189 | 190 | 11 | 36 | 113 | 59% | |
| Ti-17 (Ti-5Al-2Sn-2Zr-4Cr-4Mo) | " | 190 | 192 | 13 | 41 | 111 | 58% | |
| Ti-17 (Ti-5Al-2Sn-2Zr-4Cr-4Mo) | 1050/8 | 197 | 200 | 9 | 34 | 115 | 58% | 59.8% |
| Ti-17 (Ti-5Al-2Sn-2Zr-4Cr-4Mo) | " | 198 | 201 | 9 | 30 | 116 | 58% | |
| Ti-17 (Ti-5Al-2Sn-2Zr-4Cr-4Mo) | " | 205 | 209 | 8 | 22 | N/A | N/A | |

TABLE 1-continued

Tensile and Shear Strength Data from a commercial high strength titanium alloy (Ti-17) processed to bar*

| Alloy Chemistry (wt %) | Age (Deg F. / HRS) | YS (ksi | UTS (ksi) | % EI | % RA | Double Shear (ksi) | Double Shear as % of UTS | Avg Double Shear a % of UTS |
|---|---|---|---|---|---|---|---|---|
| Ti-17 (Ti-5Al-2Sn-2Zr-4Cr-4Mo) | " | 205 | 209 | 8 | 28 | N/A | N/A | |
| Ti-17 (Ti-5Al-2Sn-2Zr-4Cr-4Mo) | 950/12 | 211 | 216 | 9 | 25 | N/A | N/A | |
| Ti-17 (Ti-5Al-2Sn-2Zr-4Cr-4Mo) | " | 212 | 217 | 9 | 29 | N/A | N/A | |
| Regression Analysis: | | | | | | | | |
| % RA = 134.5 − 0.5080 (UTS) | | r − sq = 0.79 | | % RA @ 195 UTS = 35.4 | | | % RA @ 215 UTS = 25.3 | |
| % EL = 38.76 − 0.1427 (UTS) | | r − sq = 0.69 | | % EL @ 195 UTS = 10.9 | | | % EL @ 215 UTS = 8.1 | |

*Material solution treated at 1480° F. for 10 min followed by fan air cool

Table 1 provides tensile and double shear property data for Ti-17 0.375 inch diameter bar product produced from a nominal 10,000 lb. full-sized commercial heat. The combinations of tensile strength, shear strength and ductility exhibited in this Table are clearly exceptional for any titanium alloy. Note also that the double shear strength values average very close to the 60% of UTS value cited earlier.

SUMMARY OF THE INVENTION

The ultimate goal of this alloy development effort was to develop a heat treatable, alpha-beta, titanium alloy with improved ductility at high strength levels compared to heat treatable titanium alloys that are commercially available today, such as Ti-17. The goal could be further defined as such: to develop an alloy that exhibits at least a 20% improvement in ductility at a given elevated strength level compared to Ti-17.

While there would be significant utility for a titanium alloy with the tensile properties noted above, there would be even more utility if such an alloy could also exhibit a minimum double shear strength of at least 110 ksi. It is well known that heat treated titanium (specifically Ti-6Al-4V) is used for aerospace fasteners heat treated to a guaranteed (i.e., "minimum") shear strength of 95 ksi. The next shear strength level employed by the aerospace industry is 110 ksi minimum, a level that is not achieved with any commercially available titanium alloy but is achieved with various steel alloys. Thus, in order for titanium to offer a nominal 40% weight savings by replacing steel with titanium in a high strength aerospace fastener, the titanium alloy must exhibit a minimum double shear strength of 110 ksi. In order to do so, considering the typical scatter associated with such tests, the typical values should be at least approximately 117 ksi. With the aforementioned correlation that titanium alloys exhibit a double shear strength that is typically about 60% of the tensile strength, in order to produce a double shear strength range of at least 117 ksi (to support a 110 ksi min.), one would expect this to require a tensile strength of at least 195 ksi. (hence, in the range of 195 ksi to about 215 ksi) with "acceptable ductility". Thus, the program had a secondary goal of not only exhibiting the tensile properties noted above, but also accompanying double shear strength values to support a 110 ksi min. shear strength goal.

In accordance with the invention, there is provided an alpha-beta, titanium-base alloy having a combination of high strength and ductility and exhibiting at least a 20% improvement in ductility at a given strength level compared to alloy Ti-17, as defined herein.

More specifically, the alloy may exhibit a double shear strength of at least 110 ksi, as defined herein.

The alloy may further exhibit a tensile strength of at least 195 ksi. More specifically, the tensile strength may be within the range of 195 to 215 ksi.

The alpha-beta, titanium-base alloy in accordance with the invention comprises, in weight percent, 3.2 to 4.2 Al, 1.7 to 2.3 Sn, 2 to 2.6 Zr, 2.9 to 3.5 Cr, 2.3 to 2.9 Mo, 2 to 2.6 V, 0.25 to 0.75 Fe, 0.01 to 0.8 Si, 0.21 max. Oxygen and balance Ti and incidental impurities.

More specifically in accordance with the invention, the alpha-beta, titanium-base alloy may comprise, in weight percent, about 3.7 Al, about 2 Sn, about 2.3 Zr, about 3.2 Cr, about 2.6 Mo, about 2.3 V, about 0.5 Fe, about 0.06 Si, about 0.18 max. Oxygen and balance Ti and incidental impurities.

This alloy may exhibit a tensile strength of over 200 ksi and ductility in excess of 20% RA and double shear strength in excess of 110 ksi.

DESCRIPTION OF THE PREFERRED EMBODIMENTS AND SPECIFIC EXAMPLES

All titanium alloys evaluated in this development effort were produced by double vacuum arc melting nominally 10-lb/4.5 inch diameter laboratory size ingots. All of these ingots were converted to bar product by the same process in order to minimize property scatter due to macrostructural and/or microstructural differences. The conversion practice employed was as follows:

Beta forge at 1800 F to 1.75 inch square

Determine the beta transus

Alpha-beta roll from nominally 40 F below each alloy's beta transus to 0.75 inch square bar.

Solution treat bar at a selected temperature in the range of nominally 80 F to 150 F below its beta transus followed by a fan air cool.

Age at various temperatures in order to produce a range of strength/ductility levels.

All material was determined to have a proper alpha-beta microstructure consisting of essentially equiaxed primary alpha in an aged beta matrix.

TABLE 2

First Iteration Heats - Chemistry and Beta Transus

| Heat # | Al | Sn | Zr | Cr | Mo | V | Fe | Si | Oxygen | Beta Transus |
|---|---|---|---|---|---|---|---|---|---|---|
| V8226 | 5.05 | 1.93 | 2.09 | 4.04 | 4.00 | 0.00 | 0.22 | 0.014 | 0.110 | 1600 |
| V8227 | 4.99 | 2.09 | 1.96 | 4.34 | 4.33 | 1.56 | 0.59 | 0.027 | 0.120 | 1570 |
| V8228 | 3.79 | 1.90 | 2.32 | 3.30 | 2.61 | 2.43 | 0.48 | 0.032 | 0.164 | 1570 |
| V8229 | 4.00 | 1.84 | 2.16 | 1.89 | 3.69 | 1.42 | 1.14 | 0.024 | 0.116 | 1600 |
| V8230 | 3.85 | 1.93 | 2.17 | 2.50 | 3.96 | 1.50 | 1.20 | 0.025 | 0.181 | 1600 |
| V8231 | 3.75 | 1.96 | 1.98 | 1.56 | 3.98 | 2.92 | 1.28 | 0.037 | 0.173 | 1570 |

*Chemistries in weight pct; beta transus in degrees F.

Table 2 provides a summary of the formulations that were produced in the first iteration of laboratory size heats. The baseline Ti-17 formulation is Heat V8226. Note that the Ti-17 baseline alloy has no vanadium addition; a low (less that 0.25%) iron addition; no intentional silicon addition (0.014 represents a typical "residual" level for titanium alloys for which no silicon is added); and an oxygen level in the range of 0.08–0.13, which conforms to common industry specifications concerning Ti-17.

The remaining formulations cited in Table 2 are experimental alloys that incorporate additions/modifications relative to the Ti-17 baseline alloy. One of the primary additions is vanadium. This element is known to have significant solubility in the alpha phase (over 1%), thus it was added to specifically strengthen that phase of the resultant two-phase, alpha-beta alloy. This is an important addition since the other beta stabilizers in the Ti-17 alloy, Cr, Mo and Fe, have very limited solubility in the alpha phase. Other additions include iron and a higher oxygen level. Table 2 also shows the beta transus temperature of each formulation.

TABLE 3

First Iteration Tensile Results*

| Heat | Age | YS (ksi) | UTS (ksi) | % EI | % RA |
|---|---|---|---|---|---|
| V8226 | 950/16 | 214 | 222 | 7 | 9 |
| | " | 212 | 220 | 5 | 12 |
| | 1000/12 | 209 | 237 | 6 | 13 |
| | " | 210 | 219 | 5 | 12 |
| | 1050/8 | 203 | 207 | 7 | 17 |
| | " | 198 | 205 | 6 | 15 |
| | 1100/8 | 191 | 197 | 10 | 29 |
| | " | 191 | 197 | 9 | 25 |
| V8227 | 950/16 | 227 | 234 | 4 | 9 |
| | " | 230 | 239 | 5 | 15 |
| | 1000/12 | 222 | 222 | 6 | 15 |
| | " | 225 | 231 | 5 | 19 |
| | 1050/8 | 214 | 221 | 8 | 15 |
| | " | 213 | 220 | 6 | 12 |
| | 1100/8 | 205 | 211 | 9 | 21 |
| | " | 201 | 207 | 10 | 17 |
| V8228 | 950/16 | 206 | 214 | 8 | 22 |
| | " | 207 | 213 | 9 | 23 |
| | 1000/12 | 197 | 205 | 10 | 26 |
| | " | 194 | 201 | 14 | 39 |
| | 1050/8 | 190 | 194 | 11 | 31 |
| | " | 189 | 192 | 13 | 44 |
| | 1100/8 | 180 | 182 | 13 | 40 |
| | " | 179 | 179 | 13 | 39 |
| V8229 | 950/16 | 208 | 224 | 6 | 12 |
| | " | 209 | 218 | 7 | 11 |
| | 1000/12 | 205 | 209 | 8 | 17 |
| | " | 200 | 208 | 8 | 19 |
| | 1050/8 | 188 | 198 | 7 | 19 |
| | " | 187 | 199 | 11 | 26 |

TABLE 3-continued

First Iteration Tensile Results*

| Heat | Age | YS (ksi) | UTS (ksi) | % EI | % RA |
|---|---|---|---|---|---|
| | 1100/8 | 176 | 188 | 11 | 41 |
| | " | 178 | 187 | 12 | 38 |
| V8230 | 950/16 | 212 | 220 | 6 | 14 |
| | " | 212 | 219 | 9 | 20 |
| | 1000/12 | 204 | 211 | 11 | 26 |
| | " | 197 | 208 | 9 | 16 |
| | 1050/8 | 198 | 204 | 10 | 28 |
| | " | 195 | 202 | 9 | 23 |
| | 1100/8 | 182 | 191 | 10 | 25 |
| | " | 187 | 194 | 12 | 38 |
| V8231 | 950/16 | 208 | 220 | 6 | 18 |
| | " | 208 | 220 | 8 | 15 |
| | 1000/12 | 200 | 207 | 9 | 23 |
| | " | 199 | 208 | 10 | 28 |
| | 1050/8 | 193 | 195 | 10 | 22 |
| | " | 191 | 199 | 11 | 33 |
| | 1100/8 | 184 | 189 | 11 | 36 |
| | " | 184 | 190 | 12 | 34 |

*All material solution treated 80 degrees F. below beta transus and all aging treatments expressed in degrees F. / hours

TABLE 4

Regression Analysis of First Iteration Tensile Results

| Heat # | Equation | r-squared | Calculated % EI at 215 ksi UTS | Calculated % EI at 195 ksi UTS |
|---|---|---|---|---|
| V8226 | % EI = 26.0 − 0.0897 UTS | 0.46 | 6.7 | 8.5 |
| V8227 | % EI = 46.8 − 0.1802 UTS | 0.84 | 8.1 | 11.1 |
| V8228 | % EI = 37.3 − 0.1313 UTS | 0.60 | 9.1 | 11.7 |
| V8229 | % EI = 41.7 − 0.1635 UTS | 0.64 | 6.5 | 9.2 |
| V8230 | % EI = 31.7 − 0.1078 UTS | 0.42 | 8.5 | 10.7 |
| V8231 | % EI = 38.6 − 0.1425 UTS | 0.81 | 8.0 | 10.8 |

| Heat # | Equation | r-squared | Calculated % RA at 215 ksi UTS | Calculated % RA at 195 ksi UTS |
|---|---|---|---|---|
| V8226 | % RA = 101.0 − 0.3966 UTS | 0.62 | 15.7 | 23.7 |
| V8227 | % RA = 49.1 − 0.1513 UTS | 0.20 | 16.5 | 19.6 |
| V8228 | % RA = 138.0 − 0.5315 UTS | 0.66 | 23.7 | 34.6 |
| V8229 | % RA = 181.7 − 0.77089 UTS | 0.85 | 13.5 | 29.8 |
| V8230 | % RA = 125.1 − 0.4915 UTS | 0.48 | 19.4 | 28.6 |
| V8231 | % RA = 134.5 − 0.5325 UTS | 0.71 | 20.0 | 30.7 |

Table 3 summarizes the uniaxial tensile results obtained from the first iteration of experimental alloy formulations noted in Table 2 that were processed to bar and heat treated. Table 4 provides a regression analysis of the Table 3 data.

The first item to note is a comparison of the tensile properties of the Ti-17 material cited in Table 3 (laboratory size Ti-17 heat) vs. those cited in Table 1 (production-sized Ti-17 heat). Note that the calculated % El values of the lab-sized heat are 78% and 83% of those from the full sized heats at 195 ksi and 215 ksi respectively and the calculated % RA values are 67% and 62% at the same respective strengths. This data clearly confirms the significant drop-off of laboratory size heats vs. full-sized heats and reinforces the need to compare results from comparable sized heats.

The results summarized in Table 4 show that Heat V8228 provided the best combination of ductilities at the strength levels of 195 ksi and 215 ksi, well above those of the Ti-17 baseline alloy. In fact, compared to the Ti-17 baseline alloy, Heat V8228's % El values were 38% and 36% higher and the % RA values were 46% and 51% higher at the 195 and 215 ksi strength levels respectively, well above the goal of at least 20% improvement.

Further examination of the Table 4 data show that in all but two cases the experimental alloys from Table 2 exhibited improved properties compared to the baseline Ti-17 alloy. Only the calculated % RA of Heat V8227 at 195 ksi and the % El of V8229 at 215 ksi failed to show improvement over the Ti-17 baseline alloy. The following conclusions were drawn from these results:

- Alloys with a vanadium addition fared better than the same alloy without vanadium. The benefit of the vanadium addition appeared to peak with an addition in the range of 2.4%.
- Alloys with an elevated oxygen level performed better than those with a reduced oxygen level.
- Iron additions beyond about 0.5% do not appear to offer any advantage
- Lower aluminum levels—below about 4%—appear to be beneficial.
- All of the experimental heats had a slightly higher silicon level compared to the baseline Ti-17 level (presumably because the vanadium master alloy carried along a minor silicon level). This slightly higher silicon level was not detrimental.

TABLE 5

First Iteration Heats - Chemistry and Beta Transus

| Heat # | Al | Sn | Zr | Cr | Mo | V | Fe | Si | Oxygen | Beta Transus |
|---|---|---|---|---|---|---|---|---|---|---|
| V8247 | 3.65 | 1.96 | 2.39 | 3.23 | 2.55 | 2.37 | 0.50 | 0.035 | 0.167 | 1600 |
| V8248 | 3.72 | 2.01 | 2.44 | 3.33 | 2.60 | 2.38 | 0.50 | 0.034 | 0.222 | 1610 |
| V8249 | 3.62 | 1.94 | 2.31 | 3.16 | 2.50 | 2.36 | 0.53 | 0.069 | 0.208 | 1620 |
| V8250 | 3.64 | 1.96 | 2.31 | 3.20 | 2.57 | 2.37 | 0.48 | 0.070 | 0.174 | 1590 |
| V8251 | 3.13 | 1.97 | 2.48 | 3.17 | 2.52 | 2.35 | 0.48 | 0.035 | 0.164 | 1580 |
| V8252 | 3.16 | 1.92 | 2.43 | 3.13 | 2.48 | 2.35 | 0.46 | 0.070 | 0.171 | 1580 |

*Chemistries in weight pct; beta transus in degrees F.

In light of the excellent properties obtained from the first iteration of heats, it was decided that an additional iteration would be desirable in order to refine the chemistry of the best alloy, i.e., Heat V8228. Table 5 summarizes this second iteration of experimental heats. The first Heat, V8247, is essentially a repeat of Heat H8228. This provides a measure of the repeatability of the results. The remaining second iteration heats provide the following modifications to the V8228/V8247 formulation:

- Heat V8248 examines oxygen as high as 0.222 wt %, higher than any of the first iteration heats.
- Heat V8249 evaluates higher oxygen (0.208%) in combination with higher silicon—double that of V8247.
- Heat V8250 examines the higher silicon level alone, i.e., without the higher oxygen.
- Heats V8251 and V8252 examine lower aluminum levels (about 0.5% less than V8547), in one case at the same silicon level (V8251) and another (V8252) at the higher silicon level.

TABLE 6

2nd Iteration Tensile Test Results*

| Heat # | Age | YS (ksi) | UTS (ksi) | % EI | % RA |
|---|---|---|---|---|---|
| V8247 | 980/8 | 181 | 192 | 14 | 33 |
| | " | 185 | 196 | 12 | 28 |
| | 1040/8 | 174 | 182 | 16 | 39 |
| | " | 173 | 182 | 16 | 41 |
| | 1100/8 | 161 | 169 | 17 | 47 |
| | " | 161 | 169 | 19 | 43 |
| | 1160/8 | 152 | 162 | 18 | 50 |
| | " | 153 | 162 | 19 | 44 |
| V8248 | 980/8 | 189 | 199 | 10 | 22 |
| | " | 189 | 200 | 12 | 30 |
| | 1040/8 | 179 | 188 | 13 | 38 |
| | " | 178 | 187 | 12 | 43 |
| | 1100/8 | 167 | 175 | 15 | 40 |
| | " | 165 | 173 | 14 | 38 |
| | 1160/8 | 155 | 163 | 16 | 43 |
| | " | 155 | 163 | 16 | 44 |
| V8249 | 980/8 | 196 | 206 | 9 | 20 |
| | " | 202 | 211 | 8 | 23 |
| | 1040/8 | 186 | 195 | 12 | 34 |
| | " | 186 | 195 | 10 | 20 |
| | 1100/8 | 176 | 178 | 14 | 36 |
| | " | 174 | 182 | 12 | 27 |
| | 1160/8 | 161 | 170 | 15 | 31 |
| | " | 162 | 179 | 15 | 33 |

TABLE 6-continued

2nd Iteration Tensile Test Results*

| Heat # | Age | YS (ksi) | UTS (ksi) | % EI | % RA |
|---|---|---|---|---|---|
| V8250 | 980/8 | 186 | 197 | 11 | 33 |
| | " | 185 | 196 | 13 | 36 |
| | 1040/8 | 180 | 189 | 13 | 31 |
| | " | 178 | 187 | 14 | 37 |
| | 1100/8 | 164 | 171 | 15 | 38 |
| | " | 165 | 173 | 15 | 37 |
| | 1160/8 | 155 | 163 | 16 | 40 |
| | " | 155 | 164 | 15 | 33 |
| V8251 | 980/8 | 171 | 183 | 13 | 28 |
| | " | 173 | 184 | 14 | 33 |
| | 1040/8 | 170 | 179 | 14 | 37 |
| | " | 173 | 182 | 13 | 32 |
| | 1100/8 | 158 | 166 | 17 | 46 |
| | " | 158 | 167 | 14 | 41 |
| | 1160/8 | 149 | 158 | 18 | 47 |
| | " | 149 | 158 | 18 | 43 |
| V8252 | 980/8 | 175 | 186 | 13 | 32 |
| | " | 176 | 190 | 10 | 27 |
| | 1040/8 | 168 | 176 | 13 | 36 |
| | " | 165 | 174 | 13 | 35 |
| | 1100/8 | 156 | 165 | 16 | 42 |
| | " | 152 | 160 | 17 | 39 |
| | 1160/8 | 147 | 156 | 16 | 39 |
| | " | 147 | 157 | 18 | 40 |

*All material solution treated 80 degrees F. below beta transus and all aging treatments expressed in degrees F. / hours

TABLE 7

Regression Analysis of Second Iteration Tensile Results

| Heat # | Equation | r-squared | Calculated % EI at 215 ksi UTS | Calculated % EI at 195 ksi UTS |
|---|---|---|---|---|
| V8247 | % EI = 46.7 − 0.1719 UTS | 0.88 | 9.7 | 13.2 |
| V8248 | % EI = 38.2 − 0.1364 UTS | 0.88 | 8.9 | 11.6 |
| V8249 | % EI = 43.1 − 0.1659 UTS | 0.94 | 7.4 | 10.7 |

TABLE 7-continued

Regression Analysis of Second Iteration Tensile Results

| | | | | |
|---|---|---|---|---|
| V8250 | % EI = 35.2 − 0.1170 UTS | 0.89 | 10.0 | 12-4 |
| V8251 | % EI = 45.3 − 0.1755 UTS | 0.81 | 7.6 | 11.1 |
| V8252 | % EI = 47.0 − 0.1906 UTS | 0.87 | 6.0 | 9.8 |

| Heat # | Equation | r-squared | Calculated % RA at: 215 ksi UTS | Calculated % RA at 195 ksi UTS |
|---|---|---|---|---|
| V8247 | % RA = 130.2 − 0.5047 UTS | 0.87 | 21.1 | 31.3 |
| V8248 | % RA = 111.2 − 0.4084 UTS | 0.62 | 23.4 | 31.5 |
| V8249 | % RA = 83.85 − 0.2952 UTS | 0.68 | 20.4 | 26.3 |
| V8250 | % RA = 53.5 − 0.0993 UTS | 0.21 | 32.1 | 34.1 |
| V8251 | % RA = 13639 − 0.5726 UTS | 0.84 | 13.8 | 25.2 |
| V8252 | % RA = 93.7 − 0.3370 UTS | 0.81 | 21.2 | 28.0 |

The second iteration of laboratory size heats were processed as outlined earlier for the first iteration heats. Tensile tests were again performed and the results are summarized in Table 6. This data was analyzed by regression analysis and the results are provided in Table 7.

Several conclusions can be drawn from Table 7. First, the correlation between the first iteration heat V8228 and its replicate V8247 is quite satisfactory. Secondly, it is also clear that the alloy can tolerate oxygen up to about 0.22% when the silicon level is low, but there is a minor drop-off at the higher silicon level when in combination with the higher oxygen level. The higher silicon level seems to offer no significant loss in properties as long as the oxygen level is in the intermediate range of about 0.17%. Finally, the lower aluminum levels (below about 3.2%) appear to be inferior to the higher levels suggesting that aluminum should be kept above the 3.2% level. They all have the intermediate aluminum level of 3.6%–3.7%, and all have silicon levels that are either low in combination with the highest oxygen or high or low in combination with the intermediate oxygen levels.

TABLE 8

Tensile and Double Shear Results from Selected Heats

| Heat # | Solution Treat, F. | Age F. / hrs | YS (ksi) | UTS (ksi) | % EL | % RA | Double Shear (ksi) | Double Shear as % of UTS | Avg Double Shear as % of UTS |
|---|---|---|---|---|---|---|---|---|---|
| V8226 | Beta-110 F. | 975/12 | 186 | 213 | 5 | 12 | 106 | 49.8% | |
| " | Beta-110 F. | " | 193 | 202 | 9 | 17 | 107 | 530% | 53.4% |
| " | Beta-110 F. | 105018 | 188 | 196 | 10 | 24 | 106 | 54.1% | |
| " | Beta-110 F. | 1050/8 | 182 | 189 | 12 | 33 | 107 | 56.6% | |
| V8228 | Beta-100 F. | 975/12 | 197 | 207 | 9 | 19 | 112 | 54.1% | |
| " | Beta-100 F. | 193 | 203 | 9 | 21 | " | | 54.7% | |
| " | Beta-100 F. | 1025/8 | 189 | 198 | 13 | 38 | 108 | 54.5% | 55.0% |
| " | Beta-100 F. | " | 189 | 198 | 9 | 35 | 112 | 56.6% | |
| V8247 | Beta-130 F. | 975/12 | 191 | 202 | 12 | 31 | 110 | 54.5% | |
| " | Beta-130 F. | " | Invalid Test | | | | | | |

TABLE 8-continued

Tensile and Double Shear Results from Selected Heats

| Heat # | Solution Treat, F. | Age F. / hrs | YS (ksi) | UTS (ksi) | % EL | % RA | Double Shear (ksi) | Double Shear as % of UTS | Avg Double Shear as % of UTS |
|---|---|---|---|---|---|---|---|---|---|
| " | Beta-130 F. | 1025/8 | 189 | 198 | 13 | 38 | " | 56.1% | |
| " | Beta-130 F. | " | 189 | 198 | 9 | 35 | " | 56.1% | 55.6% |
| V8250 | Beta-150 F. | 925/12 | 191 | 204 | 11 | 29 | 113 | 55.4% | |
| " | Beta-150 F. | " | 191 | 204 | 12 | 32 | 116 | 56.9% | |
| " | Beta-150 F. | 975/12 | 187 | 198 | 12 | 38 | 112 | 56.6% | 55.9% |
| " | Beta-150 F. | " | 188 | 199 | 11 | 37 | 109 | 54.8% | |
| " | Beta-120 F. | 975/12 | 203 | 213 | 8 | 16 | 112 | 52.6% | |
| " | Beta-120 F. | " | 192 | 204 | 10 | 29 | 113 | 55.4% | |
| " | Beta-120 F. | 1025/8 | 181 | 191 | 12 | 43 | 109 | 57.1% | 55.2% |
| " | Beta-120 F. | " | 183 | 192 | 13 | 40 | 107 | 55.7% | |

Overall Avg: 55.0%

As a final determination of the property capability of the alloys produced, four of the chemistries (the baseline Ti-17 heat V8226, the best of the first iteration, Heat V8228; the replicate of V8228, Heat V8247 and Heat V8250) were selected for double shear testing. Bars from each heat were solution treated at varying degrees below their respective beta transus values, fan air cooled, and then aged at various conditions aimed at producing strength levels in the targeted 195 ksi to 215 ksi range. These bars were then tested for routine uniaxial tension properties as well as double shear. The results are provided in Table 8.

Several conclusions can be drawn from the data presented in Table 8. First, the double shear strength values of the laboratory size heats were in the range of 55% of their corresponding UTS values, with the Ti-17 baseline heat (V8226) exhibiting the lowest average at 53.4%. Since bar from the commercial Ti-17 heat exhibited an average double shear strength of 59.8% of the UTS, we see an approximate 6.4 percentage point drop-off, slightly over 10% overall, associated with the laboratory vs. commercial heat. As noted earlier regarding ductility, this is not unexpected due to the lack of macrostructural refinement afforded by the small lab heats. It does however show that one could expect nominally 10% higher values from the laboratory size formulations if they were processed from larger commercial heats. Such an increase would put the laboratory heat data shown in Table 8 into the range of 117 ksi to 129 ksi double shear strength, sufficient to meet the 110 ksi minimum goal.

What is claimed is:

1. An alpha-beta, titanium-base alloy comprising, in weight percent, 3.2 to 4.2 Al, 1.7 to 2.3 Sn, 2 to 2.6 Zr, 2.9 to 3.5 Cr, 2.3 to 2.9 Mo, 2 to 2.6 V, 0.25 to 0.75 Fe, 0.01 to 0.8 Si, 0.21 max. Oxygen and balance Ti and incidental impurities.

2. The alloy of claim 1 exhibiting at least a 20% improvement in ductility at a given strength level compared to alloy Ti-17, of comparable sized heats as defined herein.

3. The alloy of claim 2 exhibiting a double shear strength of at least 110 ksi, as defined herein.

4. The alloy of claim 3 exhibiting a tensile strength of 195 to 215 ksi.

5. An alpha-beta, titanium-base alloy comprising, in weight percent, about 3.7 Al, about 2 Sn, about 2.3 Zr, about 3.2 Cr, about 2.6 Mo, about 2.3 V, about 0.5 Fe, about 0.06 Si, about 0.18 max. Oxygen and balance Ti and incidental impurities.

6. The alloy of claim 5 exhibiting tensile strength of our 200 ksi and ductility in excess of 20% RA and double shear strength in excess of 110 ksi.

* * * * *